US005231813A

United States Patent [19]

Drawdy

[11] Patent Number: 5,231,813

[45] Date of Patent: Aug. 3, 1993

[54] INSULATED PANEL APPARATUS

[76] Inventor: Curtis P. Drawdy, 640 Kenwick Cir., Casselberry, Fla. 32707

[21] Appl. No.: 760,389

[22] Filed: Sep. 16, 1991

[51] Int. Cl.[5] ..... E04B 1/16

[52] U.S. Cl. ..... 52/309.12; 52/605; 52/251

[58] Field of Search ..... 52/309.12, 586, 605, 52/606, 607, 309.7, 437, 309.17, 309.11, 251

[56] References Cited

U.S. PATENT DOCUMENTS

| | | | |
|---|---|---|---|
| 3,416,272 | 12/1968 | La Gue | 52/606 |
| 4,285,179 | 8/1981 | Goidinger | 52/309.12 |
| 4,604,843 | 8/1986 | Ott et al. | 52/309.12 X |
| 4,614,459 | 10/1986 | Shubow | 52/309.12 |
| 4,731,971 | 3/1988 | Ferkl | 52/309.12 X |
| 4,774,794 | 10/1988 | Grieb | 52/309.12 X |
| 4,823,534 | 4/1989 | Hebinck | 52/309.12 X |
| 4,942,702 | 7/1990 | Lemasson | 52/127.7 |
| 5,074,088 | 12/1991 | Bergeron et al. | 52/309.12 |

FOREIGN PATENT DOCUMENTS

| | | | |
|---|---|---|---|
| 2324915 | 12/1974 | Fed. Rep. of Germany | 52/309.12 |
| 2456185 | 1/1981 | France | 52/607 |

*Primary Examiner*—Richard E. Chilcot, Jr.
*Assistant Examiner*—Kien Nguyen
*Attorney, Agent, or Firm*—Leon Gilden

[57] ABSTRACT

A building wall structure is arranged to positioning and securement of a plurality of panel members together, wherein each panel member is formed of a high-density foam body including an interior wall, with an exterior wall including a cementuous layer coextensive therewith. The bottom wall includes a rectilinear trough, wherein the top wall includes a trapezoidal trough to receive reinforcing rod positioned within a cementuous bonding agent contained therewithin. End walls of the panel members are arranged for receiving end wall cementuous materials and reinforcing rod members to assist in securement of adjacent panel members together. Load supporting walls are imbedded within the top wall cementuous materials as required. The panel members include spaced parallel interior cavities coextensive with and extending from the top wall into the bottom wall into communication with the top and bottom wall troughs for receiving additional reinforcing cementuous material and reinforcing rod structure therewithin.

1 Claim, 4 Drawing Sheets

INSULATED PANEL APPARATUS

BACKGROUND OF THE INVENTION

1. Field of the Invention

The field of invention relates to construction panel members, and more particularly pertains to a new and improved insulated panel apparatus wherein the same is arranged for securement of adjacent panel members together to define a continuous wall structure of predetermined length and configuration.

2. Description of the Prior Art

Modular construction of building members is required in an effort to reduce cost, labor, and time associated with construction of wall assemblies. Prior art structure in this regard may be found and exemplified in U.S. Pat. No. 4,917,742 to Watanabe, et al. wherein a lightweight panel formed of a honeycomb board structure utilizing a phenolic foam is set forth.

U.S. Pat. No. 4,813,193 to Altizer sets forth a modular building panel utilizing a framework utilizing foam insulation contained within the panel construction.

U.S. Pat. No. 4,858,403 to Lingle sets forth a fastening bar assembly for mounting frameless insulating panels together.

U.S. Pat. No. 4,937,122 to Talbert sets forth an insulated construction panel formed of wooden planks containing foam expanding material therebetween.

As such, it may be appreciated that there continues to be a need for a new and improved insulated panel apparatus as set forth by the instant invention which addresses both the problems of ease of use as well as effectiveness in construction to permit assemblage of panel members together to form variously configured wall construction and in this respect, the present invention substantially fulfills this need.

SUMMARY OF THE INVENTION

In view of the foregoing disadvantages inherent in the known types of panel apparatus now present in the prior art, the present invention provides an insulated panel apparatus wherein the same is arranged for the securement and mounting of adjacent panel members together. As such, the general purpose of the present invention, which will be described subsequently in greater detail, is to provide a new and improved insulated panel apparatus which has all the advantages of the prior art panel apparatus and none of the disadvantages.

To attain this, the present invention provides a building wall structure arranged to position and secure a plurality of panel members together, wherein each panel member is formed of a high-density foam body including an interior wall, with an exterior wall including a cementuous layer coextensive therewith. The bottom wall includes a rectilinear trough, wherein the top wall includes a trapezoidal trough to receive reinforcing rod positioned within a cementuous bonding agent contained therewithin. End walls of the panel members are arranged for receiving end wall cementuous materials and reinforcing rod members to assist in securement of adjacent panel members together. Load supporting walls are imbedded within the top wall cementuous materials as required. The panel members include spaced parallel interior cavities coextensive with and extending from the top wall into the bottom wall into communication with the top and bottom wall troughs for receiving additional reinforcing cementuous material and reinforcing rod structure therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of this invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved insulated panel apparatus which has all the advantages of the prior art panel apparatus and none of the disadvantages.

It is another object of the present invention to provide a new and improved insulated panel apparatus which may be easily and efficiently manufactured and marketed.

It is a further object of the present invention to provide a new and improved insulated panel apparatus which is of a durable and reliable construction.

An even further object of the present invention is to provide a new and improved insulated panel apparatus which is susceptible of a low cost of manufacture with regard to both materials and labor, and which accordingly is then susceptible of low prices of sale to the consuming public, thereby making such insulated panel apparatus economically available to the buying public.

Still yet another object of the present invention is to provide a new and improved insulated panel apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 11 is an isometric illustration of panel members formed with spaces therebetween for accommodating various building components such as doors, windows, and the like.

DESCRIPTION OF THE PREFERRED EMBODIMENT

Figure 1:
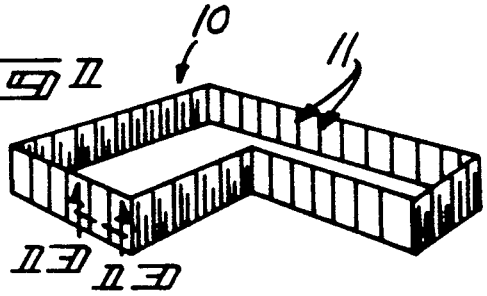
FIG. 1, FIG. 2, FIG. 4, FIG. 6, and FIG. 8 are each isometric illustrations of panel members of the instant invention assembled together to form wall structure of various configurations.
Figure 2:
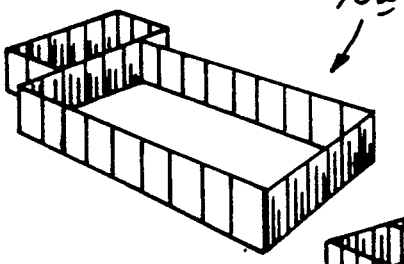
Figure 3:
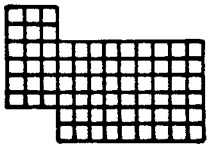
FIG. 3 is a plan view of the construction as set forth in FIG. 2.
Figure 4:
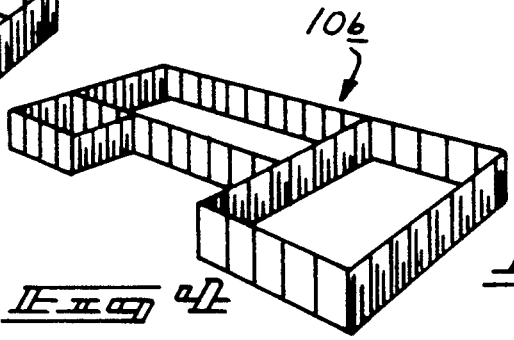
Figure 5:
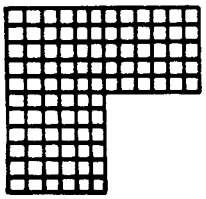
FIG. 5 is a plan view of the wall construction as set forth in FIG. 1.
Figure 7:
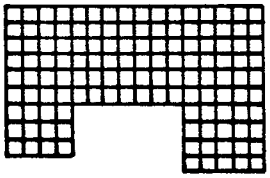
FIG. 7 is a plan view of the wall construction as set forth in FIG. 4.
Figure 6:
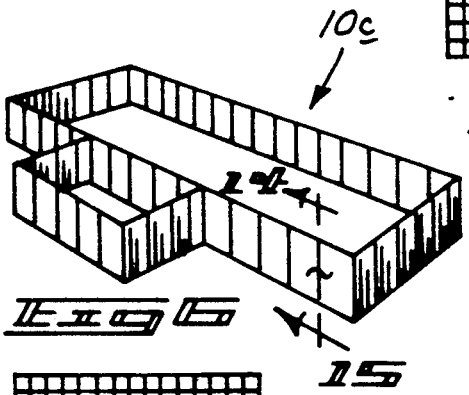
Figure 9:
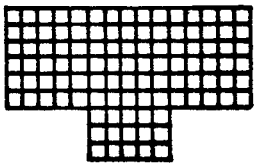
FIG. 9 is a plan view of the wall construction as set forth in FIG. 6.
Figure 8:
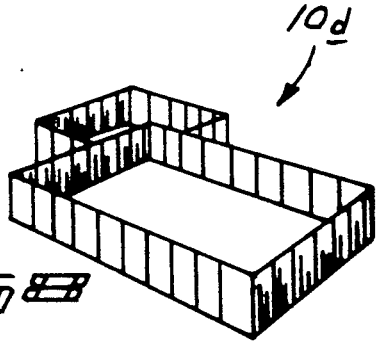
Figure 10:
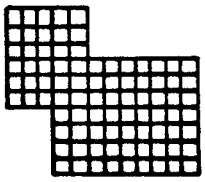
FIG. 10 is a plan view of the wall construction as set forth in FIG. 8.

With reference now to the drawings, and in particular to FIGS. 1 to 22 thereof, a new and improved insulated panel apparatus embodying the principles and concepts of the present invention and generally designated by the reference numerals 10–10*d* will be described.

Figure 16:
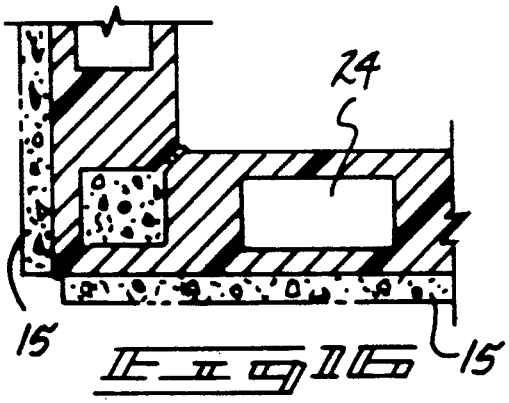
FIG. 16 is a top plan view of a mitre joining of adjacent panels together.
Figure 17:
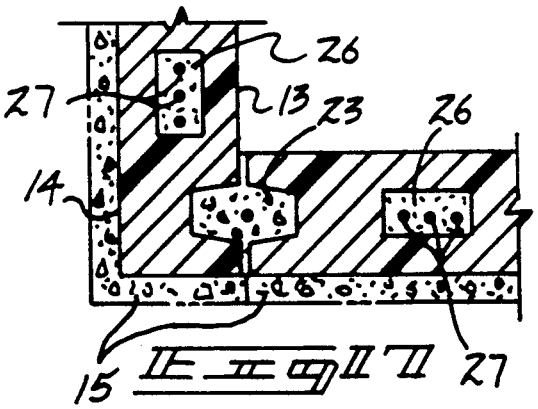
FIG. 17 is a top orthographic view of a butt joining of a plurality of panels together.
Figure 18:
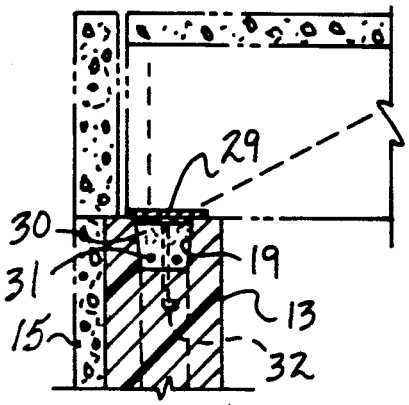
FIG. 18 is an orthographic cross-sectional view utilizing a wall bearing support member associated with the instant invention.
Figure 19:
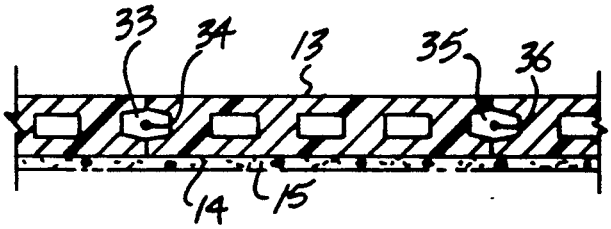
FIG. 19 is a top orthographic view of the joining of a plurality of panels together.
Figure 20:
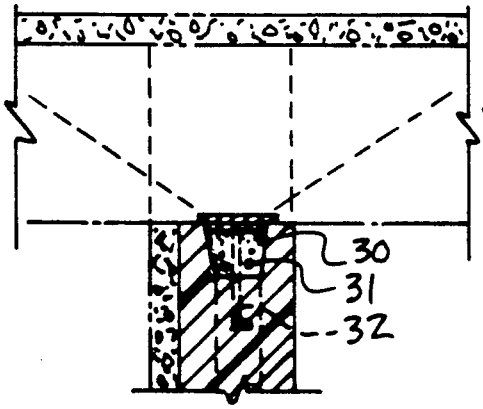
FIG.20 is an orthographic cross-sectional view of a panel construction utilizing a load bearing floor plate.
Figure 21:
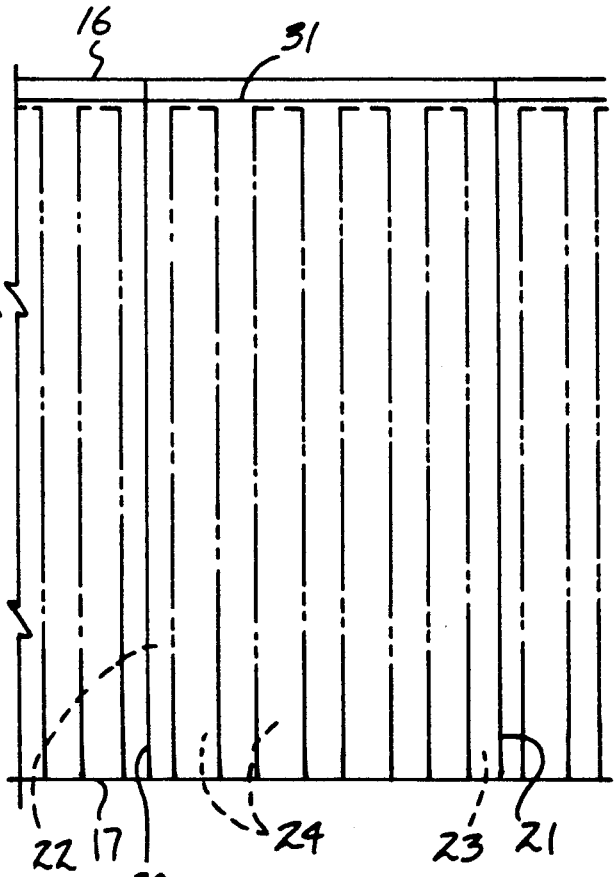
FIG. 21 is an orthographic rear view of a plurality of panels illustrating the various structural components in association of the panels together.
Figure 22:
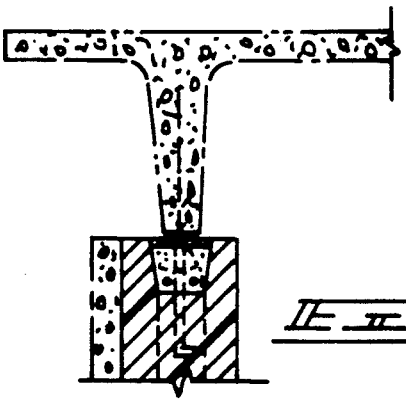
FIG. 22 is an orthographic partial end view of the panel member mounting a cantilever support thereon.

More specifically, the insulated panel apparatus 10 of the instant invention essentially comprises a plurality of panel members 11 positioned in adjacency relative to one another to provide for a wall construction, as illustrated in the FIGS. 1–10 of various floor plans, as set forth by the numerals 10, 10*a*, 10*b*, 10*c*, and 10*d*. Each panel member includes a high density foam body 12 (see FIG. 13 for example) of a polymeric commercially available foam material, such as polymeric isocyanate polyol resin. Each panel member 11 includes an interior wall 13 spaced from an exterior wall 14, with a top wall 16 spaced from a bottom wall 17 and defined by a first end wall 20 spaced from a second end wall 21. A cementuous layer 15 or simulation thereof is adhered coextensively to the exterior wall 14. The bottom wall 17 includes a rectilinear parallelepiped bottom wall through 18 that is coextensive with the bottom wall 17 to accommodate a bottom wall insulative sealer material 28 directed coextensively along the bottom wall 17 and as required within the bottom wall through 18 for positioning the panel member 11 upon a support surface "S". The top wall 16 includes a top wall through 19 defined by a trapezoidal cross-sectional configuration to accommodate a top wall cementuous filler 30 that includes reinforcing rods 31 coextensive with the top wall of a plurality of adjacent panel members 11, as illustrated in the FIG. 21 for example. The top wall cementuous filler 30 includes at least one and desirably a plurality of reinforcing rods 31 arranged in a parallel relationship contained wholly within the top wall cementuous filler 30 to provide for strength to the top wall to receive a support plate 29 thereon to accommodate various structural components, such as a wall, a floor, or a cantilever construction, as illustrated in the FIGS. 18, 20, and 22 respectively. The first end wall 20 and the second end wall 21 each include respective first and second end wall cavities 22 and 23 arranged coextensively relative to each end wall and medially thereof for abutment with adjacent first and second end wall cavities 22 and 23 of adjacent end walls, such as exemplified in the FIGS. 16 and 19 for example, to accommodate various mitre and end-to-end relationships of adjacent panel members. FIG. 16 illustrates a butt junction of a plurality of panel members for mounting together, wherein the first end wall cavity 22 includes a first end wall cementuous material for joinder of adjacent panel members together, that include first end wall reinforcing rods 36 positioned therewithin. Similarly, the second end wall cavity 23 includes a second end wall cementuous material 33 to include second end wall reinforcing rod or rods 34 contained therewithin to provide structural integrity and strength in the joinder of adjacent panels together. The panel members 11 further include equally spaced parallel interior cavities 24 that are arranged orthogonally relative to the top and bottom walls 16 and 17 and are directed coextensively through the panels members 11 to receive interior cavity cementuous filler 26 including interior cavity reinforcing rods 27 therewithin. Further, first rigid reinforcing rods 25 as required are positioned adjacent and between the interior cavities 24 and are directed coextensive therewith to provide structural integrity to the high density foam bodies 12 of each of the panel members 11.

Figure 11:
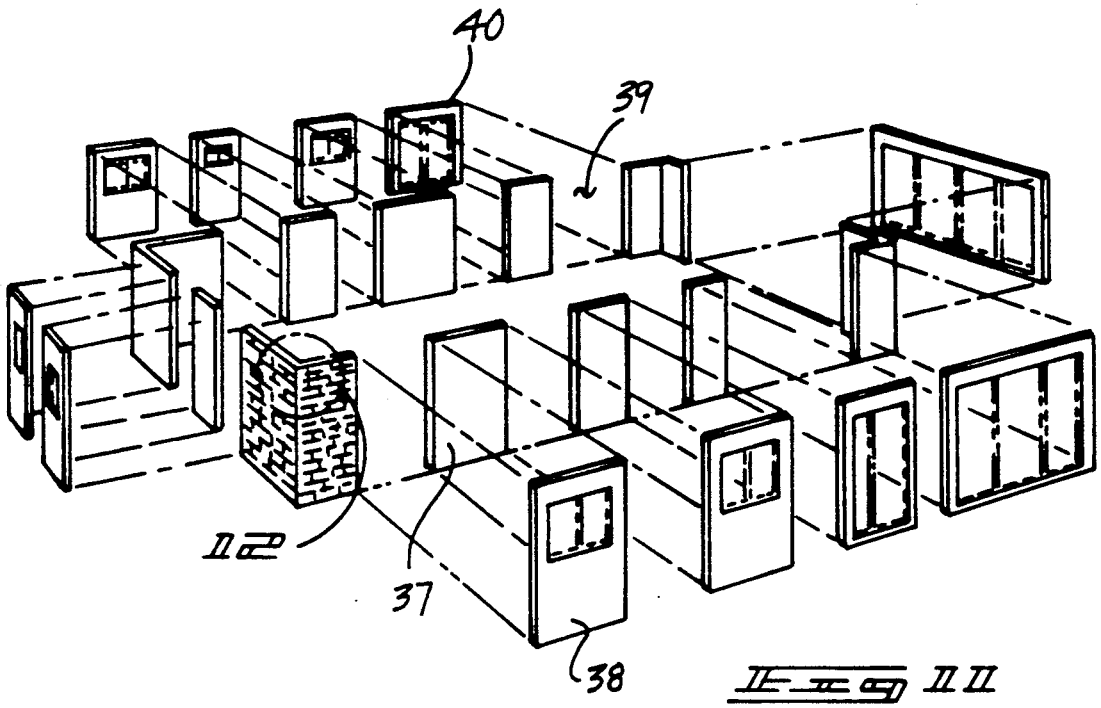
Figure 12:
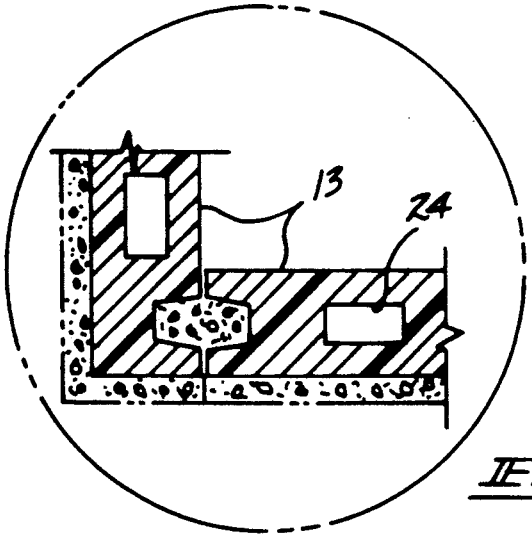
FIG. 12 is an enlarged sectional view of section 12 as set forth in FIG. 11.
Figure 13:
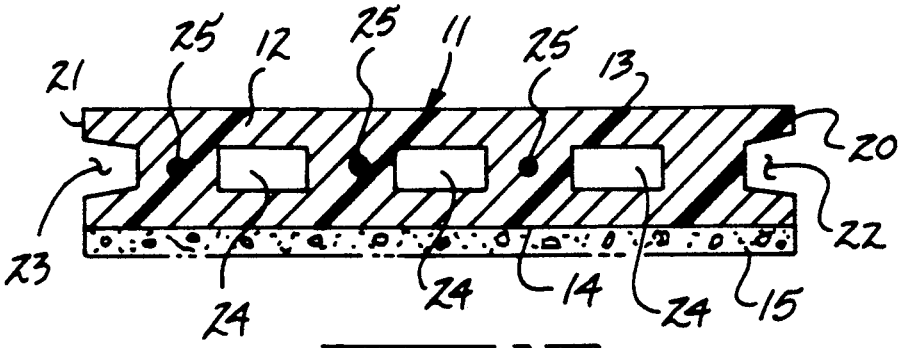
FIG. 13 is an orthographic view, taken along the lines 13—13 of FIG.1 in the direction indicated by the arrows.
Figure 14:
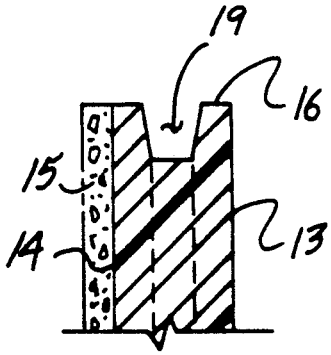
FIG. 14 is an orthographic view, taken along the lines 14—14 of FIG. 6 in the direction indicated by the arrows.
Figure 15:
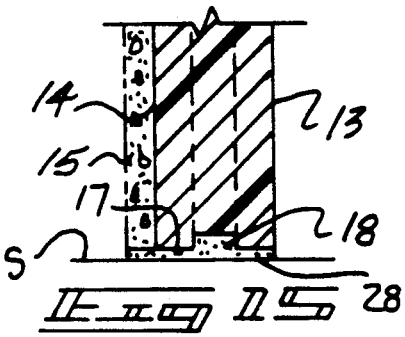
FIG. 15 is an orthographic cross-sectional view, taken along the lines 15—15 of FIG. 6 in the direction indicated by the arrows.

The panel members may be constructed as illustrated in the FIGS. 1–10 and further the FIG. 11 is exemplified to provide for respective door and window openings 37 and 39 to receive respective door and window members 38 and 40 therewithin to provide for a structural wall readily assembled and of flexible engineering design to accommodate various architectural configurations as required.

As to the manner of usage and operation of the instant invention, the same should be apparent from the above disclosure, and accordingly no further discussion relative to the number of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An insulated panel apparatus, comprising, at least one panel member, the panel member including a high density polymeric foam body defined by an interior wall spaced from an exterior wall, a top wall spaced from a bottom wall, and a first end wall spaced from a second end wall, the exterior wall including a cementuous layer coextensive with the exterior wall, and the top wall including a trapezoidal top wall trough, the bottom wall including a rectilinear parallelepiped bottom wall trough, wherein the top wall trough and the bottom wall trough are arranged parallel relative to one another and coextensive with the respective bottom wall and top wall, the first end wall including a first end wall cavity coextensive with the first end wall, and a second end wall including a second wall cavity coextensive with the second end wall, and wherein the top wall trough includes a top wall cementuous filler contained coextensively therewithin, wherein the top wall cementuous filler includes at least one reinforcing rod wholly contained within the top wall cementuous filler and parallel to the top wall, and the bottom wall includes a bottom wall insulative sealer material coextensive with the bottom wall and received within the bottom wall trough, and the first end wall cavity and the second end wall cavity include respective first end wall and second end wall cementuous material contained coextensively therewithin, wherein the first end wall cementuous material includes at least one first end wall reinforcing rod coextensive with the first end wall cavity, and the second end wall cementuous material includes at least one second end wall reinforcing rod contained therewithin, wherein the first end wall reinforcing rod and the second end wall reinforcing rod are arranged parallel relative to one another, and a plurality of equally spaced parallel interior cavities contained within the high density foam body between the interior wall and the interior wall extending orthogonally between the top wall and the bottom wall, and each interior cavity includes an interior wall cavity cementuous filler contained therewithin, and the interior cavity cementuous material includes at least one interior cavity reinforcing rod contained coextensively within the interior cavity cementuous filler and coextensive with the interior cavity, and a first rigid reinforcing rod is positioned between adjacent interior cavities and a further first rigid reinforcing rod positioned between the said interior cavity and the said first end wall, and a yet further first rigid reinforcing rod positioned between the said interior cavity and the second end wall, and the top wall cementuous filler includes a support plate secured thereto and received within the top wall trough to accommodate a structural component thereon.

* * * * *